United States Patent [19]

Woodham

[11] Patent Number: 5,005,621

[45] Date of Patent: Apr. 9, 1991

[54] METHOD, SYSTEM, AND APPARATUS FOR DEBARKING ROUNDWOOD

[75] Inventor: Donald V. Woodham, Monticello, Ark.

[73] Assignee: Price Industries, Monticello, Ark.

[21] Appl. No.: 401,407

[22] Filed: Sep. 1, 1989

[51] Int. Cl.[5] ..... B27L 1/02

[52] U.S. Cl. ..... 144/208 B; 144/341; 241/189 R; 241/147

[58] Field of Search ..... 241/300, 189 R, 197, 241/191; 144/208 R, 208 B, 341

[56] References Cited

U.S. PATENT DOCUMENTS

| | | | |
|---|---|---|---|
| 3,020,943 | 2/1962 | Hjartsater | 144/208 B |
| 3,262,477 | 7/1966 | O'Brien | 144/208 B |
| 3,286,747 | 11/1966 | Delcellier | 144/208 B |
| 3,301,289 | 1/1967 | Hanson | 144/208 B |
| 3,783,918 | 1/1974 | Simpson | 144/208 B |
| 4,374,533 | 2/1983 | Svensson | 144/208 B |
| 4,774,987 | 10/1988 | Sepling | 144/208 B |

*Primary Examiner*—W. Donald Bray
*Attorney, Agent, or Firm*—Brisebois & Kruger

[57] ABSTRACT

A rotating drum debarker is provided which includes a conveyor chute to feed logs to the drum. The drum includes lifters and reinforcing rings. The improvement in drum design is obtained where the reinforcing ring at the inlet and/or outlet of the drum has an inside diameter greater than the free inside diameter of the drum.

18 Claims, 6 Drawing Sheets

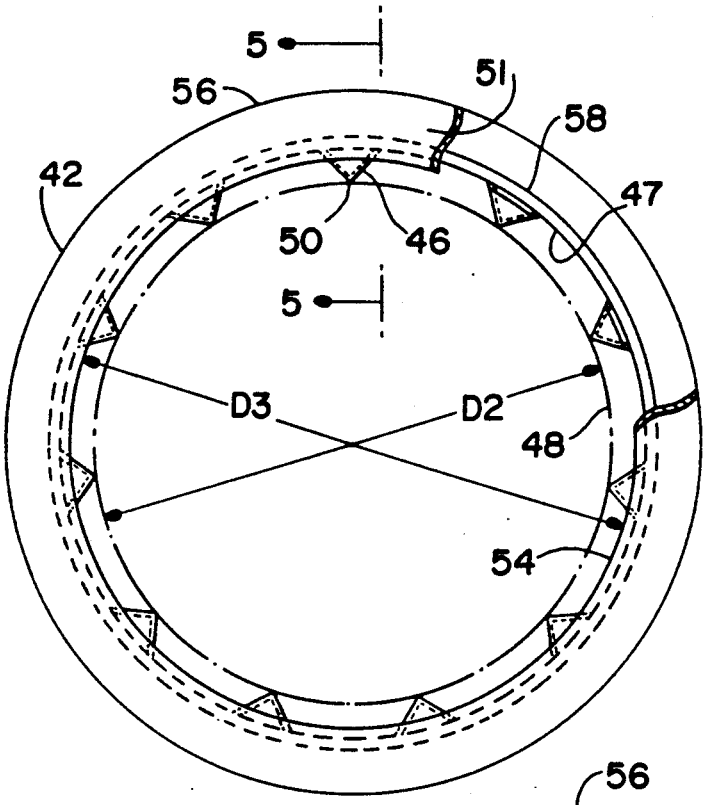
Fig- 4
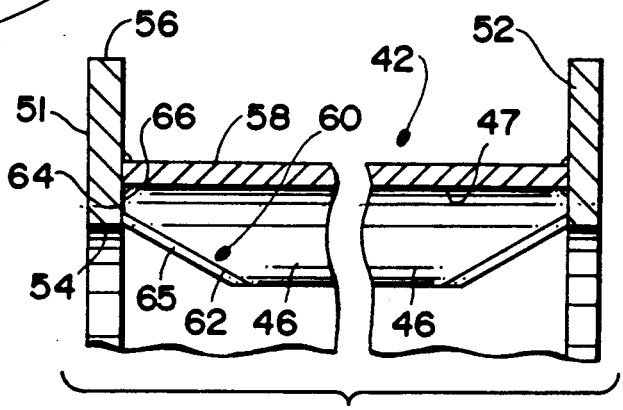
Fig- 5
Fig- 7
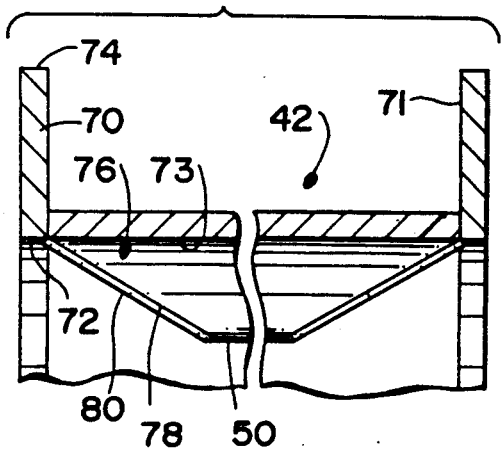
Fig- 9
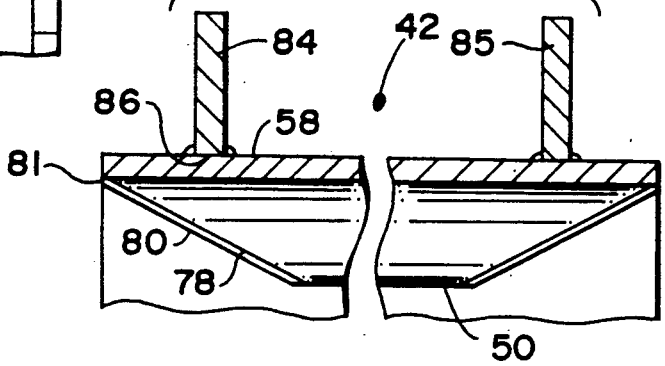

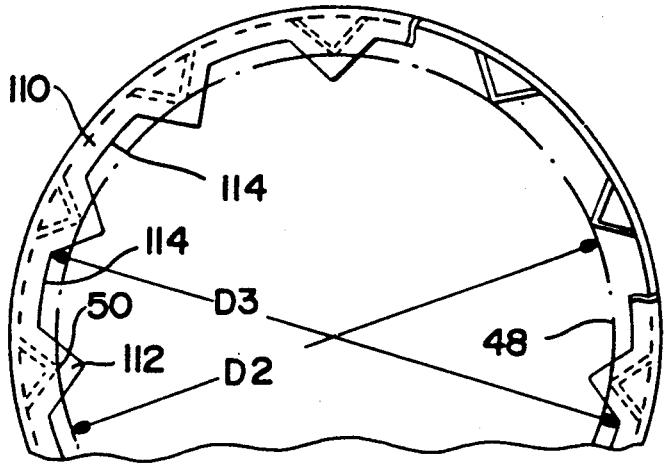
Fig- 14
Fig- 15
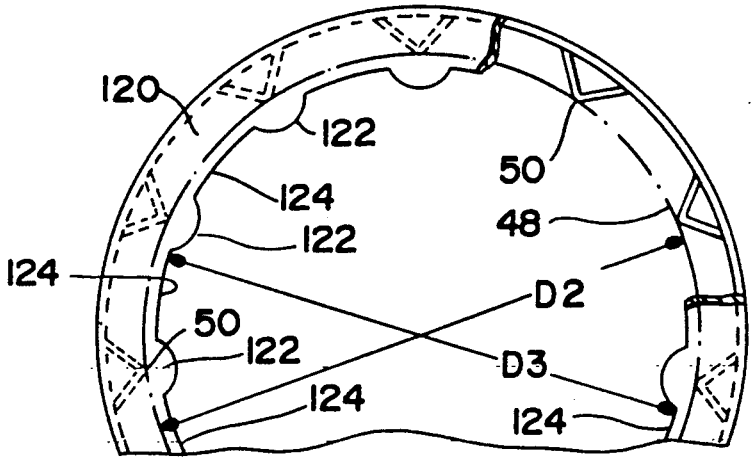
Fig- 16
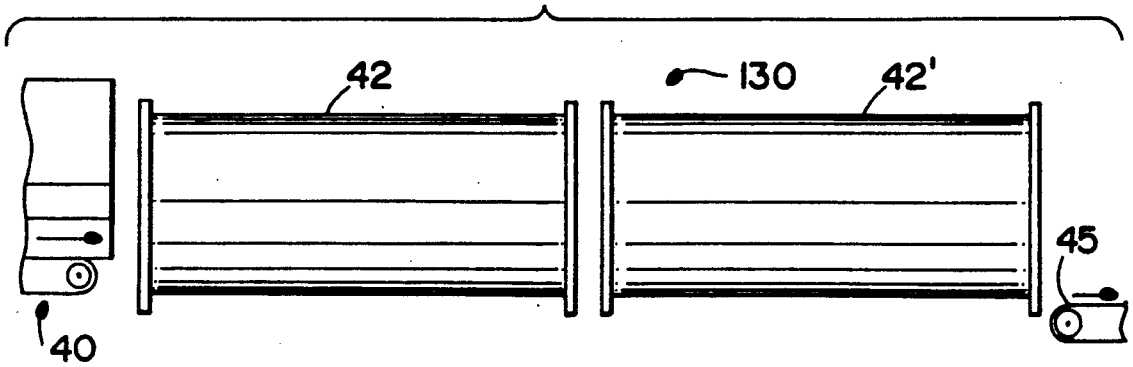

METHOD, SYSTEM, AND APPARATUS FOR DEBARKING ROUNDWOOD

This application is related to copending application Ser. No. 278,778, filed Dec. 2, 1988, now abandoned, and the disclosure thereof is incorporated herein by reference.

This invention relates to improvements in rotating drum debarkers for removing bark from logs and similar roundwood, particularly long roundwood. More particularly, the invention relates to improved reinforcing ring and log lifter arrangements which reduce flailing of logs and improve the movement or flow of long logs into and through the drum, when fed from a conveyor or inclined chute in front of the drum, but which also work well with any length logs.

BACKGROUND OF THE INVENTION

Rotating drum debarkers of the type having lifters in the form of circumferentially spaced apart projections extending inwardly from the inner surface of the drum shell are well known. A typical debarking drum takes the form of a relatively thin cylindrical shell with the lifters welded to the inside of the shell, and with slots in the wall of the shell in the regions between the lifters for discharging removed bark from the drum. The lifters extend the length of the shell and serve to stiffen and reinforce the shell.

A typical lifter takes the form of a length of U, V, or L shaped angle iron or channel with the ends of both its legs welded to the inside of the shell so the tip or peak of the lifter points toward the axis of the drum. A stiffening or reinforcing ring is secured to each end of the drum, and the ends of the lifters are usually welded to the inner side surfaces of these rings.

Thus, the lifters cooperate with the shell and the reinforcing rings to provide a beam reinforced skin structure which is quite strong even though the shell skin or side wall of the drum is relatively thin.

In the past, roundwood was cut to relatively short lengths for drum debarking because the short lengths were easy to handle with the available equipment. The trend today is toward debarking of tree length logs, to enable obtaining as much usable lumber as possible, and to provide long lengths which can be chipped more efficiently for pulpwood use, where the logs after debarking, are found to be unsuitable for use as lumber.

In the past, the reinforcing ring provided at the inlet and outlet ends of the drum had an inside diameter less than the diameter of the circle defined by the tips of the lifters, and covered the ends of the lifters. Logs entering the drum could then roll on the inside of the ring before engaging the lifters, and the ring at the outlet end served the additional purpose of providing a dam to restrict the flow of logs from the drum in order to provide more time in the debarking drum for debarking.

Such a drum arrangement is not satisfactory for use with long roundwood fed, for example, by a conveyor or chute in front of the drum, either to a single drum debarker, or to a debarker with two drums, one downstream of the other, which are rotated in the same or in opposite directions during debarking. Long logs partly in the drum tend to roll around the inlet ring so their trailing ends flail and gyrate, and some gyration and clogging occurs at the outlet.

In a two drum arrangement the logs sometimes roll and sometimes slip on the rings at the discharge end of the first drum and the inlet end of the second drum, with resulting decreased debarking efficiency.

SUMMARY OF THE INVENTION

In accordance with the invention, it has been found that flailing and gyration of the trailing ends of logs fed part way into the debarking drum from a conveyor in front of the drum can be decreased by providing means adjacent the inlet of the drum for intermittently engaging and displacing logs inwardly away from the inside surface of the drum. These means can take the form of inwardly projecting portions of the lifters and/or the reinforcing ring adjacent the inlet of the drum.

It has been found, in accordance with one aspect of the invention, that improved debarking of logs fed from a conveyor or chute in front of the drum is obtained where the reinforcing ring at the drum inlet and/or outlet has an inside diameter greater than the free inside diameter of the drum, i.e. the diameter of a circle passing through the tips or radially innermost portions of the log lifters, so that the lifters are exposed to engage and agitate logs entering and leaving the drum.

It has been found, in accordance with another aspect of the invention, that improved debarking is obtained where the reinforcing ring at the inlet and/or outlet of the drum has an inside diameter greater than the free inside diameter of the drum, but less than the inside diameter of the drum shell, so that at least portions of the lifters are exposed at the inlet and outlet to agitate and displace logs entering and/or leaving the drum.

It has further been found, according to the invention, that the rings of existing drums can be modified for improved debarking by cutting away or scalloping the reinforcing rings at the inlet and/or outlet of the drum, so that the diameter of the ring between lifters is greater than the diameter of a circle passing through the log engaging portions of the lifters, but less than the inside diameter of the drum shell.

For a new drum being constructed, it is preferred to cut the ends of the lifters at an angle so they slope outwardly toward the inside of the drum shell, particularly at the inlet end of the drum. However, where the ring (or rings) of an existing drum is modified by scalloping the ring, good infeed and discharge are obtained, with minimal flailing of the logs, or clogging at the outlet.

It is preferred, in accordance with the invention to make the reinforcing ring of a larger outside diameter than the outside diameter of the drum.

It is thus an object of the invention to provide an improved reinforcing ring arrangement for a drum debarker in which the reinforcing ring adjacent at least one end of the drum has an inside diameter greater than the free inner diameter at the peaks of the lifters.

It is another object to provide an improved reinforcing ring arrangement for a drum debarker in which the reinforcing ring adjacent at least one end of the drum has an inside diameter larger than the free inner diameter at the peaks of the lifters, but smaller than the inside diameter of the shell of the drum.

Another object is a reinforcing ring and lifter arrangement in which the inside of the reinforcing ring adjacent at least one end of the drum is scalloped in the regions between selected adjacent lifters.

Another object is a reinforcing ring and lifter arrangement in which the ends of the lifters diverge at the ends of the drum and slope outwardly from the peaks of the lifters toward the inner surface of the drum, and can be welded to the rings.

A further object is a reinforcing ring and lifter arrangement in which the ends of the lifters are cut at an angle and are covered with sloping plates.

Another object is a method of modifying an existing drum by removing portions of the reinforcing ring between lifters, and if required, adding a reinforcing ring to the outside of the drum, adjacent the inlet and/or outlet to further strengthen the drum.

Another object is a debarking drum having means adjacent the inlet thereof, for displacing logs fed from a conveyor in front of the drum away from the inner surface of the drum inlet.

Another object is a method and apparatus for enhancing the flow of logs into and through a debarking drum by agitating the logs as they pass through the inlet of the drum.

Another object is a method and apparatus enhancing the flow of logs from a debarking drum by agitating the logs as they pass through the outlet of the drum.

Another object is a method and apparatus for removing long logs from a debarking drum by agitating the logs as they pass through the outlet of the drum and pulling partly discharged logs from the drum with a conveyor at the outlet of the drum.

Another object is a method and apparatus for removing long logs from a debarking drum by pulling partly discharged logs through the outlet of the drum with a conveyor which slopes away from the outlet of the drum, either with or without agitating the logs as they pass through the outlet of the drum.

Another object is a two drum debarking apparatus having debarking drums in accordance with one or more of the above objects.

Other features and advantages of the invention will become apparent from the drawings and the detailed description which follows.

BRIEF DESCRIPTION OF THE DRAWINGS

FIG. 4 is a front end view of a first embodiment of the drum of the system and apparatus of FIG. 3;

FIG. 5 is an enlarged view in section of the first embodiment, taken along line 5—5 of FIG. 4;

FIG. 7 is an enlarged view in section of the second embodiment, taken along line 7—7 of FIG. 6;

FIG. 9 is an enlarged view in section of the third embodiment, taken along line 9—9 of FIG. 8;

FIG. 14 is a partial front end view of a drum showing a variation of the embodiment of FIGS. 12 and 13;

FIG. 15 is a partial front end view of a drum showing another variation of the embodiment of FIGS. 12 and 13;

FIG. 16 shows a two drum debarking system and apparatus according to the invention;

DETAILED DESCRIPTION OF PREFERRED EMBODIMENTS

Figure 1:
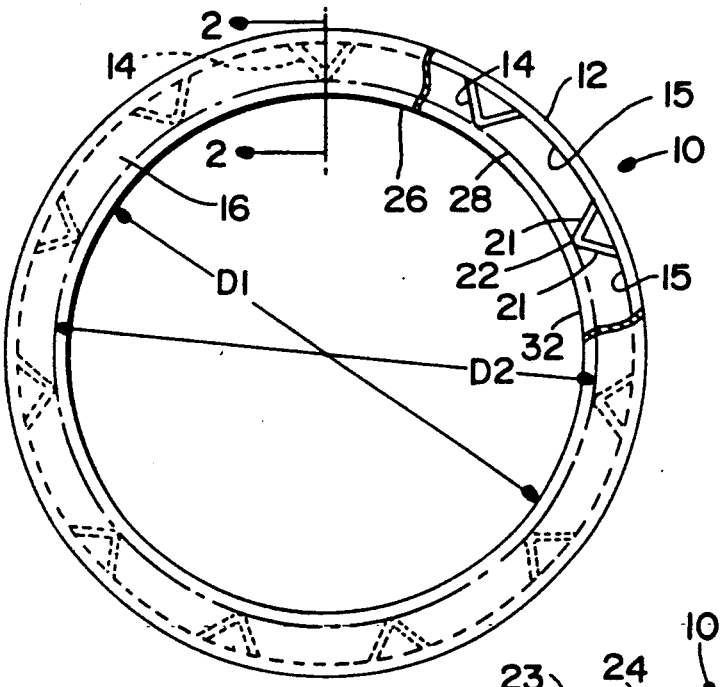
Fig. 1 PRIOR ART
FIG. 1 is a front end view of a prior art debarking drum.
Figure 2:
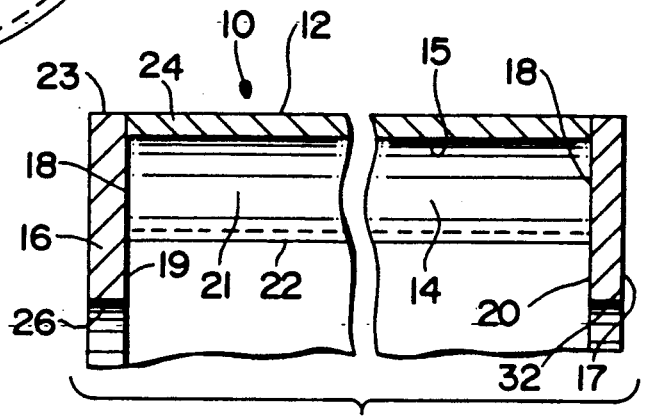
Fig. 2 PRIOR ART
FIG. 2 is an enlarged view in section, taken along line 2—2 of the prior art debarking drum of FIG. 1.

FIGS. 1 and 2 show a typical debarking drum of prior known construction. The drum assembly 10 is in the form of a cylindrical shell or drum 12 with a plurality of lifter elements 14 which are welded to the inside surface 15 of the shell and can extend the length of the drum. At the inlet end of the drum assembly 10 is a reinforcing ring 16, and there is a reinforcing ring 17 at the outlet end. The respective ends 18 of the lifters extend to and are welded to the inner faces 19 and 20 of the respective rings 16 and 17.

The lifters 14 are lengths of L shaped angle iron having the ends of their legs 21 welded to the inside surface of drum 12 so the V shaped corner or peak 22 of each lifter points toward the axis of the drum, and the outer faces of the legs 21 define log engaging portions of the lifters. The reinforcing ring 16 at the inlet of the drum has an outside diameter 23 the same as the outside diameter 24 of the drum, and an inside diameter 26 somewhat smaller than the inside diameter of the drum 12.

As shown at FIG. 1, a circle of diameter D1 which is the inside diameter 26 of the reinforcing ring, is smaller than the diameter D2 which is the diameter of a circle 28 (shown in dot-dash lines) passing through the peaks 22 of the lifter elements 14 The diameter of the inner surface 32 of the outlet reinforcing ring 17 is the same as or smaller than the diameter D1 of inlet ring 16.

Figure 3:
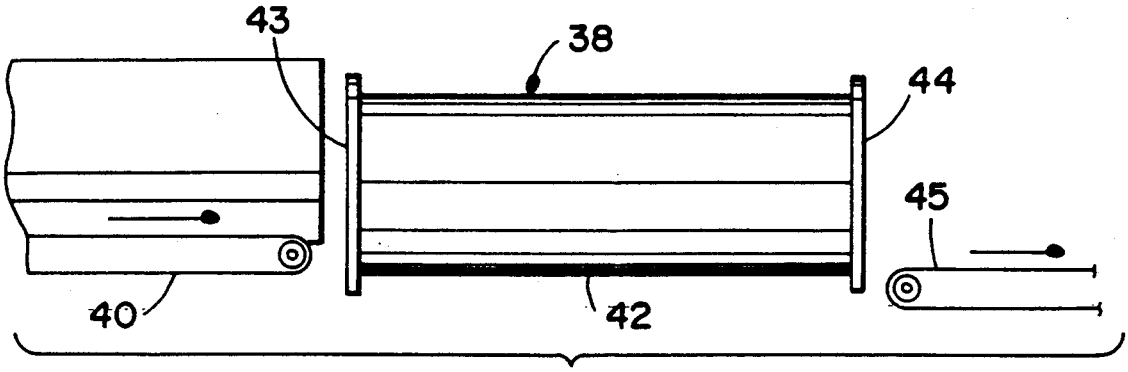
FIG. 3 is side view in elevation of a system and apparatus according to the invention.

FIG. 3 shows a system and apparatus 38 according to the invention. As shown, there is a generally horizontal conveyor 40 which feeds roundwood into an improved debarking drum assembly 42, according to the invention. The conveyor 40 and feeding arrangement can be of the type shown and described in copending application Ser. No. 278,778, which is owned by the assignee of this application. Instead of conveyor 40, an inclined chute, for example, can be used to feed logs into the drum, and the chute can be fed by a conveyor upstream of the chute, or logs can be loaded directly into the chute with a crane.

In operation of apparatus 38, a bundle of perhaps 10 or 12. logs, each of a length of perhaps 40 to 60 feet, is fed into the inlet end 43 of the drum from the conveyor 40, and when a first bundle of logs is part way in the drum, another bundle is loaded onto the conveyor 40. The conveyor 40 and drum 42 are simultaneously driven so that the upstream logs push the downstream logs through the continuously rotating drum to effect debarking in a continuous stream. Downstream of the outlet end 44 of the drum is a conveyor 45 or similar means for transporting the debarked logs away from the drum.

It has been found that a debarking drum assembly of the construction of FIGS. 1 and 2 does not work well when long roundwood is fed into the drum, for example, from the conveyor 40, of the apparatus of FIG. 3.

Among the problems encountered are violent flailing of the trailing ends of logs fed part way into the drum, and the tendency for logs to resist leaving the drum even though they are pushed axially by incoming logs from the conveyor 40.

These problems are minimized, according to the invention, by providing one of several embodiments of a debarking drum 42, which will now be described.

FIGS. 4 and 5 show a first embodiment of debarking drum 42 according to the invention.

As shown at FIG. 4, the lifters 46 are V-shaped, are welded to the inside surface 47 of the drum, and a circle 48 (in dot-dash lines) of a diameter D2 passes through the peaks 50 of the lifters. An inlet reinforcing ring 51 and outlet reinforcing ring 52 are welded to the end faces of the drum or shell 42. Inlet reinforcing ring 51 has an inside surface 54 of a diameter D3 which is greater than the diameter D2 of the circle 48 passing through the peaks of the lifters. The outside diameter of outer surface 56 of ring 51 is somewhat greater than the diameter of the outside surface 58 of the drum 42.

As shown at FIG. 5, the ends 60 of the lifters 46 are cut at an acute angle to the axis of the drum, to provide a beveled portion 62, while leaving a short flat end portion 64 which abuts and is welded to the inner side face 66 of the ring 51. The beveled portion 62 of each lifter is closed by a triangular cover plate 65 which is welded to the edges of the beveled portion 62 and to the ring 51, adjacent its inner surface 54. The angle of the beveled portion with respect to the axis of the drum is 25 to 35 degrees, 30 degrees being preferred. Thus, the end of each lifter slopes outwardly toward and meets the inner surface 54 of the ring 51. The construction is the same at outlet ring 52.

For a drum 42 with an inside diameter of about 9 feet and where the lifters each project radially about 5 inches from the inner surface 47 of the drum, the inside surface 54 of ring 51 can have a diameter D3 about 4 inches less than the inside diameter of the drum (radius about 2 inches less than inside radius of drum), and an outside diameter about 6 inches greater than the outside diameter of drum 42 (radius 3 inches greater than outside radius of drum).

Figure 6:
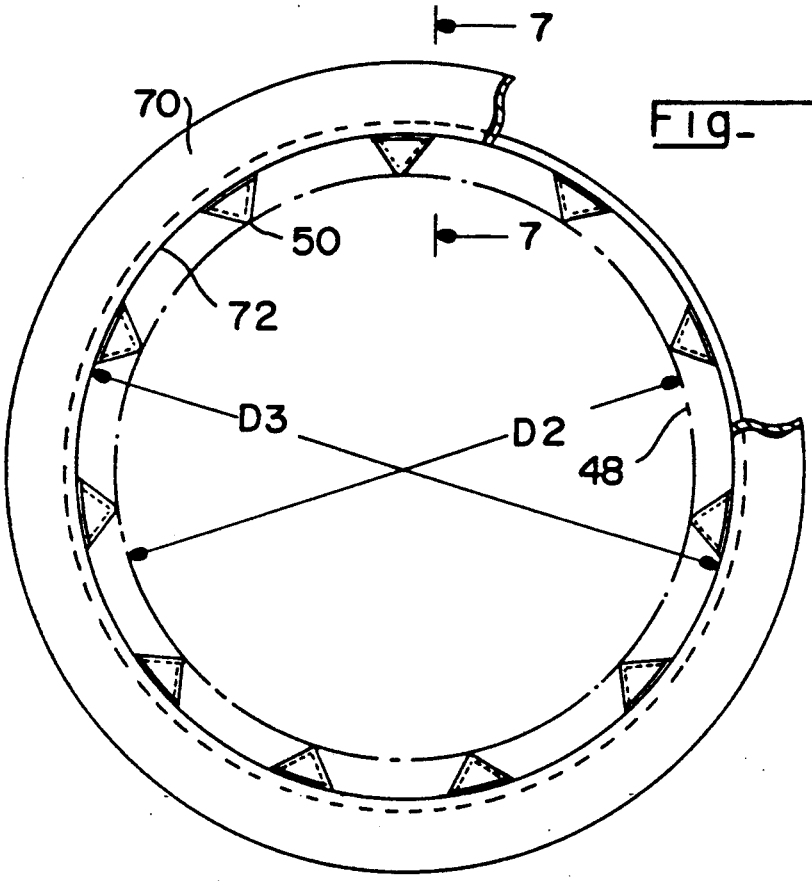
FIG. 6 is a front end view of a second embodiment of the drum of the system and apparatus of FIG. 3.

FIGS. 6 and 7 show another embodiment with an inlet reinforcing ring 70, and an outlet reinforcing ring 71. Inlet reinforcing ring 70 has an inside surface 72 of a diameter D3 which is the same as the diameter of the inside surface 73 of the drum 42, and an outside surface 74 of a diameter somewhat greater than the outside diameter of the drum. In this embodiment the diameter D3 of the inside surface 72 of ring 70 is greater than the diameter D2 of the circle 48 through the lifter peaks, by an amount equal to twice the radial height of the lifters. The ends 76 of the lifters are cut at an angle along a sloping line, extending from the front end of the inner surface 72 of the drum, and which intersects the axis of the drum, to provide a beveled portion 78 which extends to the inside surface 72 of the ring 70.

The beveled portion 78 of each lifter is closed by a triangular cover plate 80 which is welded to the edges of the beveled portion 78 and to the ring 70, adjacent its inside surface 72. The angle of the beveled portion 78 with respect to the axis of the drum is 25 to 35 degrees, 30 degrees being preferred. Thus, the end of each lifter slopes outwardly toward and meets the inside surface 72 of the ring 70. The ring 70 can have an outside diameter 6 to 8 inches greater than the outside diameter of the drum 42. The construction is the same at outlet ring 71.

Figure 8:
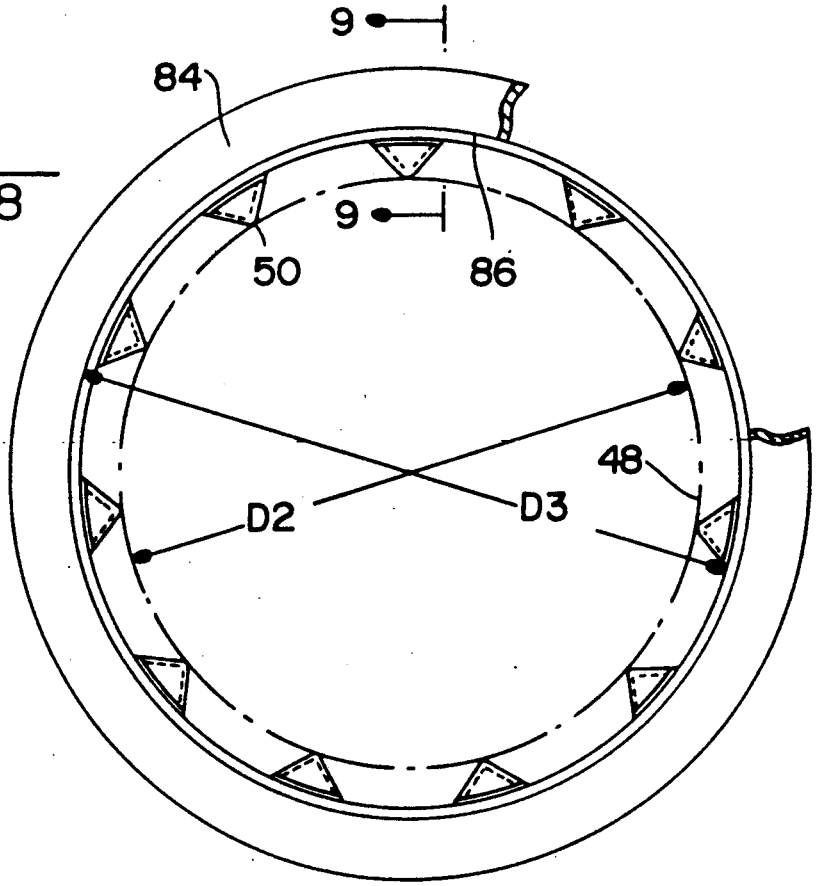
FIG. 8 is a front end view of a third embodiment of the drum of the system and apparatus of FIG. 3.

FIGS. 8 and 9 show an embodiment in which the inlet reinforcing ring 84 and outlet reinforcing ring 85 are mounted on the outer surface 58 of the drum. The inlet reinforcing ring is mounted a short distance of about three to six time the thickness of the ring from the inlet end of the drum. Thus, the inside surface 86 of reinforcing ring 84 has an inside diameter D3 about equal to the diameter of the outside surface 58 of drum 42, and which is greater than the diameter D2 of the circle 48 passing through the peaks 50 of the lifters. In this embodiment, the ends of the lifters have a beveled portion 78, and a cover plate 80, as in the embodiment of FIGS. 6 and 7, but the end edges 81 of the cover plates are welded to the inside surface of the drum adjacent the ends of the drum.

Figure 10:
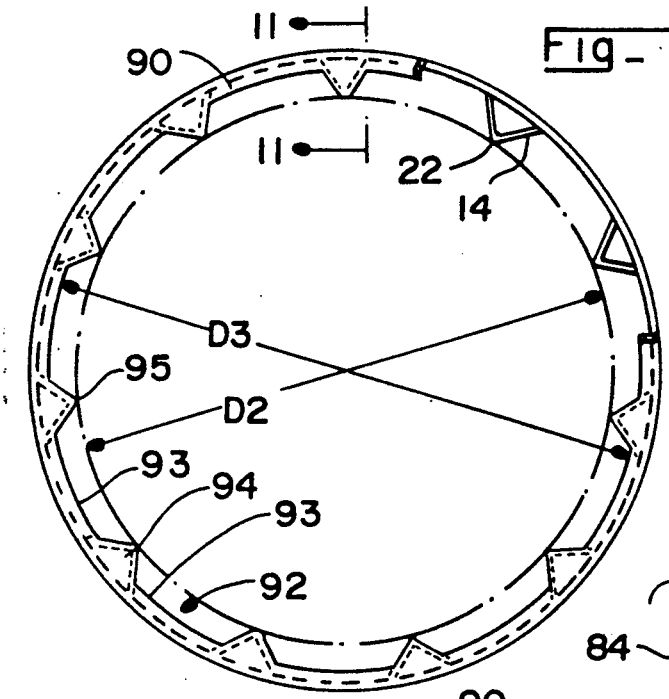
FIG. 10 is a front end view of another embodiment of the drum of the system and apparatus of FIG. 3.
Figure 11:
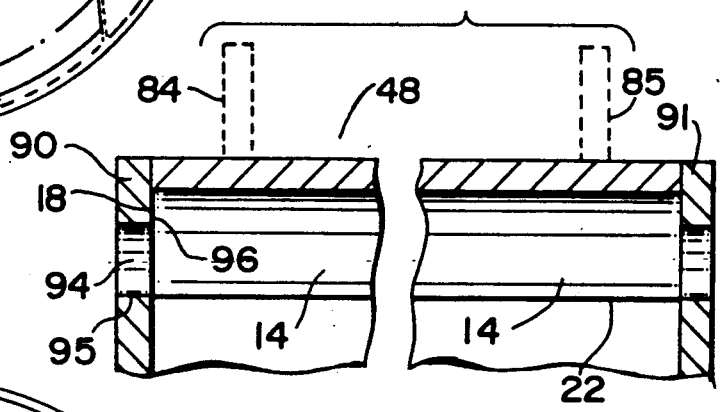
FIG. 11 is an enlarged view in section taken along line 11—11 of FIG. 10.

FIGS. 10 and 11 show an embodiment in which there are lifters 14, essentially the same as those of the prior art of FIGS. 1 and 2, which have flat radial ends 18 and peaks 22. An inlet reinforcing ring 90 and outlet reinforcing ring 91 are welded to the ends of the drum. Inlet reinforcing ring 90 has a scalloped inside surface 92 which includes arcuate regions 93 between adjacent lifters, and projections 94 of the same shape and size as the ends of the lifters, and which extend over and cover the ends of the lifters. The arcuate regions 93 are of a diameter D3, which is greater than the diameter D2 of a circle 48 passing through the peaks 50 of the lifters (which also passes through the peaks 95 of the projections 94 of the ring which cover the ends of the lifters). The ends of the lifters are welded to the inner side face 96 of the ring 90, and are also welded to the ring along the projections 94.

FIGS. 10 and 11 also show the method of modifying the embodiment of FIGS. 1 and 2, in accordance with the invention. In this method, the rings 16 and 17 of FIG. 1, are cut away, for example with a cutting torch, to provide the scalloped inner surface 92 with the curved surfaces 93 and projections 94 of the rings 90 and 91 of FIGS. 10 and 11. For additional strength, rings 84 and 85 (shown in dotted lines at FIG. 11), can be added at the outside of the drum. These outside rings 84 and 85 are the same as those of the embodiment of FIGS. 8 and 9.

Figure 12:
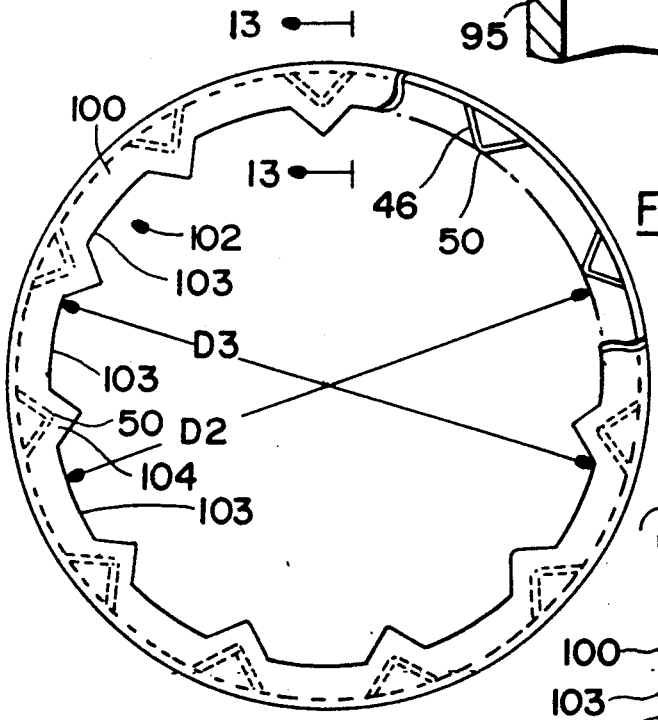
FIG. 12, is a front end view of another embodiment of the drum of the system and apparatus of FIG. 3.
Figure 13:
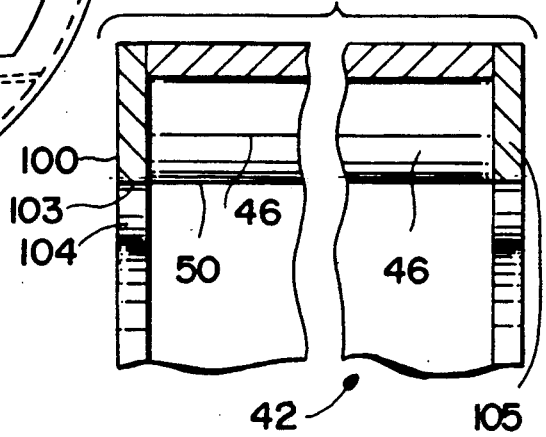
FIG. 13 is an enlarged view in section taken along line 13—13 of FIG. 12.

FIGS. 12 and 13 show another embodiment according to the invention. In this embodiment there is an inlet ring 100 with a scalloped inside surface 102 including arcuate regions 103 between adjacent lifters 46, and projections 104 of a size and shape to cover the flat radial ends of the lifters, and to extend inwardly of the peaks 50 of the lifters. The diameter D3 of arcuate regions 103 is essentially the same as the diameter D2 of the circle 48 through the tips 50 of the lifters.

These projections 104 minimize rolling of logs around the inside of the ring 100. The projections 104 bump the portions of those logs which engage the arcuate regions 103 of the ring and force the logs inwardly away from the ring and the inner surface of the drum. Thus a log which may have rolled on the ring to a position above the center-line of the drum while its leading end is engaging the bottom of the drum, is intermittently displaced inwardly so its frictional contact with the ring is released, thus decreasing its tendency to roll higher. The outlet ring 105 can be the same as the inlet ring.

FIG. 14 shows a variation of the embodiment of FIGS. 12 and 13 As shown at FIG. 14, the scalloped ring 110 has projections 112 which extend radially inwardly of the lifters, and inside surfaces 114 between lifters of an inner diameter D3 which is greater than the circle 48 of diameter D2 through the peaks 50 of the lifters. The outlet ring can be of the same construction.

FIG. 15 shows another variation of the embodiment of FIGS. 12 and 13. As shown at FIG. 15, the scalloped ring 120 has projections 122 which extend radially inwardly of the lifters, and inside surfaces 124 between lifters of an inner diameter D3 which is smaller than the circle 48 of diameter D2 through the peaks 50 of the lifters. However, the projections 122 of the ring extend inwardly of the surfaces 124, a distance sufficient to displace logs away from these surfaces 124, to thus minimize rolling of logs around the inside surfaces of the ring. The projections can be of a profile different from the section of the lifters, for example, rounded, as shown at FIG. 15. The outlet ring can be of the same construction.

The description above has been primarily directed to the reinforcing ring at the inlet of the drum. The reinforcing ring and lifter end configuration at the outlet of the drum of all the above embodiments can be the same as at the inlet of the drum. Further, the reinforcing ring and lifter end configuration at the inlet can be different from the reinforcing ring and lifter configuration at the outlet. In accordance with the invention, any one of the inlet ring and lifters described above at the inlet end of the drum, can be used with any of the described outlet ring and lifters at the outlet end of the drum. For example, the inlet ring 100 and corresponding inlet lifters of the embodiment of FIGS. 12 and 13 can be used with the outlet ring 85 and corresponding outlet lifters of the embodiment of FIGS. 8 and 9.

The exact mechanism of the improved flow of logs through the drum, and reduced flailing of the trailing ends of the logs is not known with certainty. It is believed, however, that in the embodiments of FIGS. 4 to 9, the exposed lifters adjacent the inlet of the drum engage or bump the sides of logs partly within the drum and tend to displace such logs inwardly away from the drum sidewall. Such bumping and inward displacement occurs each time a log is engaged by the portion of a lifter adjacent the drum inlet, and the resulting intermittent contact with the inner surface of the ring or inner perimeter of the drum is believed to minimize rolling of such logs upwardly and around the drum inlet.

A similar action is believed to occur with the embodiments of FIGS. 10, 11, where the reinforcing ring is scalloped in the region between lifters, as well as in the embodiments of FIGS. 12 to 15, where the tips of the ring projections project inwardly of the lifters at the inlet of the drum. In these embodiments the ring projections engage the sides of the logs at the drum inlet to bump and displace the logs inwardly away from the curved inner surfaces of the inlet ring.

The action at the outlet of the drum is quite similar, with the rings and corresponding outlet end lifters of the embodiments of FIGS. 4 to 11 being preferred because of the minimum resistance to log outflow. The outlet rings and lifters of the embodiments of FIGS. 12 to 15 can however, be used to advantage for difficult to remove bark. The impacting and lateral displacement of the logs as they are struck by the lifters or outlet ring projections enhances debarking efficiency. While in general, a smaller inner diameter ring at the outlet tends to increase the residence time of the logs in the drum, the projections have the effect of reducing clogging of logs in the drum, even where the inner diameter of the ring at the outlet is the same as or less than the diameter of the circle D2 through the tips of the lifters, as in the embodiment of FIGS. 12, 13, and 15.

In all the embodiments of the invention of FIGS. 4 to 15, the logs are agitated by the exposed lifters or ring projections as they enter or leave the drum, and such agitation is believed to improve the flow and the debarking action, particularly of long logs.

The exact combination of inlet and outlet lifter and ring configurations used will depend on the nature of the logs to be debarked.

FIG. 16 shows another system and apparatus 130 according to the invention, which is similar to FIG. 3 but in which there is a second debarking drum 42' immediately downstream of the upstream debarking drum 42 into which logs are fed from conveyor 40. Where the logs are difficult to debark, the downstream debarking drum 42' can be rotated in a direction opposite to the direction of rotation of the upstream drum 42. Debarked logs are carried away by conveyor 45 downstream of drum 42'.

Any of the inlet ring and corresponding inlet lifter configurations can be used at the inlets of the drums 42 and 42', and any of the outlet ring and corresponding outlet lifter configurations can be used at the outlets of these drums. For example, the inlet ring 51 with inlet lifter ends 60 of the embodiment of FIGS. 4 and 5 can be used at the inlet of upstream drum 42, the ring and lifters of the embodiment of FIGS. 6 and 7 can be used at the outlet of upstream drum 42 and at the inlet of downstream drum 42', and the ring and lifter arrangement of FIG. 12 can be used at the outlet of downstream drum 42'.

Where drums 42 and 42' are existing drums, the rings at the inlet and outlet of both can be modified in the manner described above for the embodiment of FIGS. 10 and 11.

Figure 17:
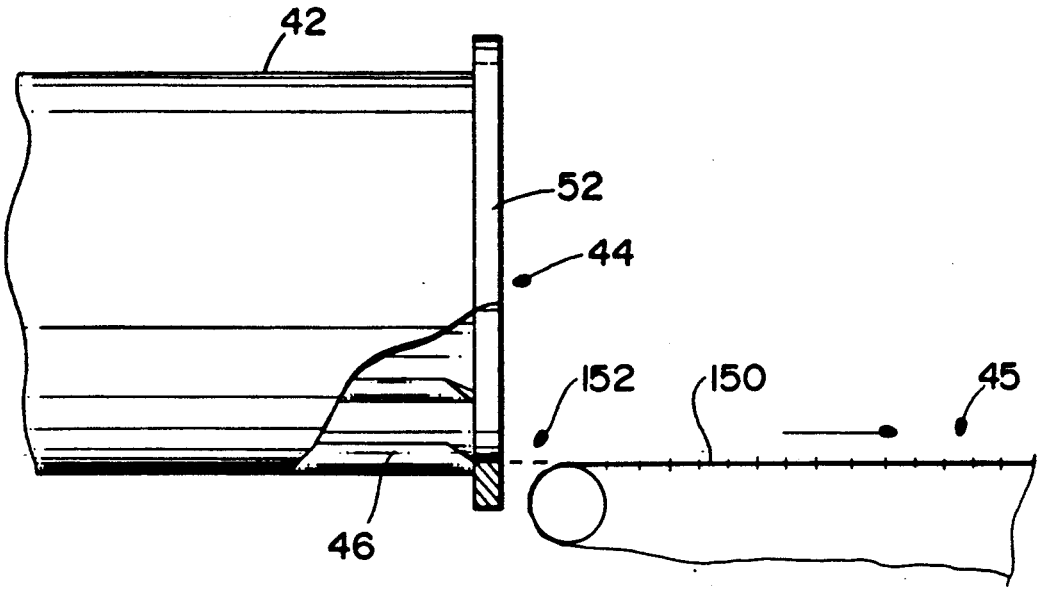
FIG. 17 shows a conveyor arrangement for removing long logs from the drum.

In accordance with another aspect of the invention, the discharge conveyor 45 is positioned so that its top surface 150 is at the same elevation as the inner surface of the bottom of the drum at the drum outlet. FIG. 17 shows the outlet 44 of drum 42 equipped with the outlet ring 52 and lifters 46 of the embodiment of FIGS. 4 and 5. As shown at FIG. 17, dot-dash line 152 in the plane of the top of conveying surface 150 of the conveyor is at the same elevation as the inside surface 54 of ring 52 at the bottom of the drum. Thus the conveying surface 150 engages horizontal logs which engage the surface 54, as well as logs which extend partly through the outlet and are tilted. The agitation of the logs causes by the exposed lifter ends causes the logs to engage the conveyor conveying surface 150 which is preferably a chain, so that the chain extracts or pulls the logs out of the drum outlet. It is preferred to drive the conveyor chain at a speed greater than the speed at which logs flow through the drum so that the logs are somewhat separated and axially staggered on the conveyor.

Figure 18:
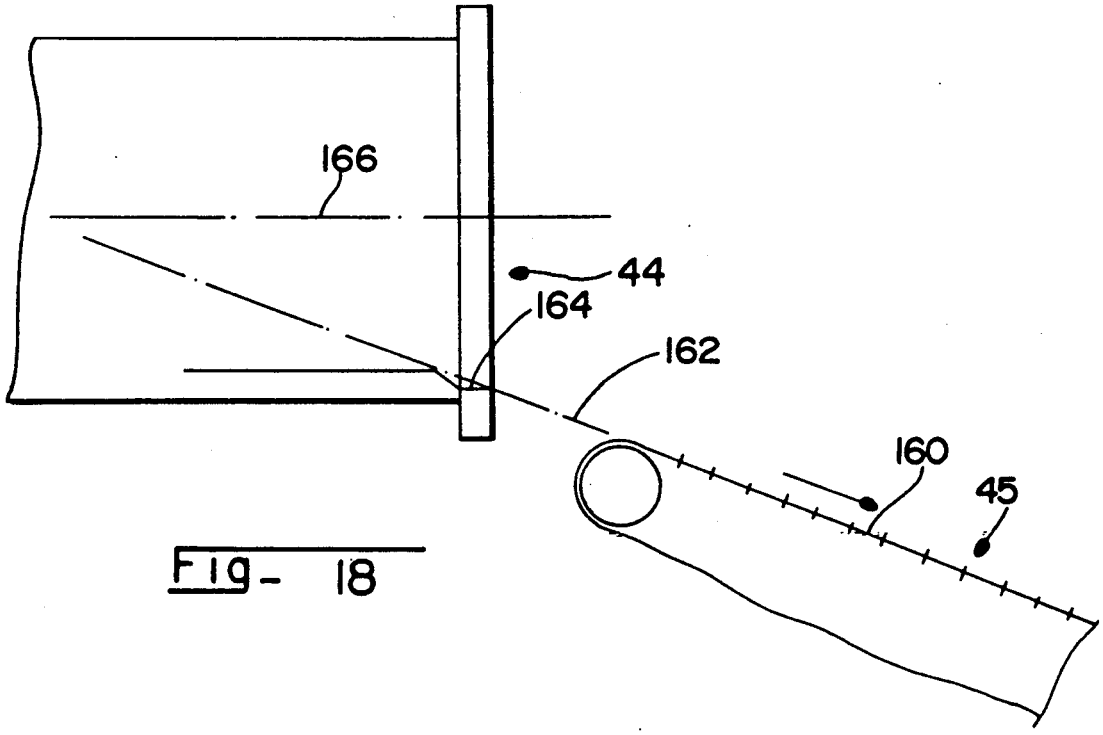
FIG. 18 shows another apparatus according to the invention which includes a conveyor that slopes away from the outlet of the drum for removing long logs from the drum.

In another embodiment, as shown at FIG. 18, a discharge conveyor 46 is provided which slopes away from the outlet 44 of the debarking drum. The top surface 160 of the conveyor chain extends along a line 162 which passes through the inside surface 164 at the bottom of the drum, and makes an acute angle with the axis 166 of the drum. Logs which are tumbling and have partly passed out of the drum tend to extend at an angle to the drum and there is better surface to surface contact between the leading log ends and the conveying surface 160 which slopes away from the bottom inner surface of the drum outlet. The combined agitating of the logs as they leave the drum and the sloping driven conveying surface provide very good log removal and extraction from the drum. It is preferred that the conveying surface 160 slope away from the axis of the drum at an angle not greater than 15 degrees. A preferred angle is about 5 degrees, but good results can be obtained where the angle is between about 5 and 15 degrees.

The sloping conveying surface of FIG. 18 can also be used with the prior known reinforcing ring 17 shown at FIGS. 1 and 2.

While the systems and apparatus of the invention have been shown and described with the lifters each of the same radial height, and substantially equally spaced circumferentially within the drum, some lifters can be of different heights, and the circumferential spacing can be varied so it is not the same between adjacent lifters.

Changes and variations can be made without departing from the scope of the invention.

I claim:

1. Apparatus for debarking roundwood, said apparatus comprising, a generally horizontal rotary drum debarker having a drum with an inside surface, an inlet end and an outlet end, means in front of the drum for feeding roundwood into the drum, a plurality of circumferentially spaced apart elongated lifter elements connected to the inside of the drum for rotation with the drum and having log engaging portions inwardly of the inside surface of the drum so that the roundwood fed into the drum is rotated and lifted by said lifter elements, and a reinforcing ring connected to the drum adjacent one of said ends, said reinforcing ring having an inside diameter greater than the diameter of a circle passing through the log engaging portions of said lifter elements, means adjacent the other end of the drum for reinforcing said other end of the drum, wherein said lifter elements have sloping ends adjacent an end of the drum which slope toward the inside surface of the drum, and cover plates secured to said sloping ends of said lifters.

2. Apparatus according to claim 1 wherein said cover plates comprise plates which extend to said reinforcing ring, and means securing said plates to said reinforcing ring.

3. Apparatus for debarking roundwood fed into a debarking drum rotatable about an axis, from a feeder in front of the inlet of the drum, said apparatus comprising, a generally horizontal rotary drum debarker having a drum with an inside surface, an inlet end and an outlet end, feeder means in front of the drum at an elevation below the axis of the drum for feeding roundwood longitudinally into the drum, a plurality of circumferentially spaced apart elongated lifter elements connected to the inside of the drum for rotation with the drum and having log engaging portions inwardly of the inside surface of the drum so that roundwood fed into the drum is rotated and lifted by said lifter elements, and a reinforcing ring connected to the drum adjacent said inlet end, said reinforcing ring having an inside diameter greater than the diameter of a circle passing through the log engaging portions of said lifter elements to allow the lifter elements to engage logs entering the drum and thereby minimize rolling of the logs around the inlet of the drum, and means adjacent the outlet end of the drum for reinforcing said outlet end of the drum.

4. Apparatus according to claim 3 wherein said means for reinforcing the outlet end of the drum comprises an additional ring.

5. Apparatus according to claim 4 wherein said additional reinforcing ring comprises a ring having an inside diameter greater than the diameter of a circle passing through the log engaging portions of said lifter elements.

6. Apparatus according to claim 5 wherein said inside diameter of at least one of said rings is smaller than the diameter of the inside surface of said drum.

7. Apparatus according to claim 6 wherein the inside diameter of both of said rings is smaller than the diameter of the inside surface of said drum.

8. Apparatus according to claim 6 wherein the outside diameter of at least one of said rings is greater than the outside diameter of the drum.

9. Apparatus according to claim 8 wherein the outside diameter of both of said rings is greater than the outside diameter of said drum.

10. Apparatus according to claim 4 wherein the structure of said inlet ring and lifter elements at said ends of the drum are substantially the same.

11. Apparatus according to claim 4 wherein the structure of said ring and lifter elements adjacent said ends of the drum are different.

12. Apparatus according to claim 4 wherein said lifter elements have sloping ends adjacent an end of the drum which slope toward the inside surface of the drum.

13. Apparatus for debarking logs fed into the inlet of a rotary drum debarker having a sidewall, from a feed means in front of the drum for feeding long logs longitudinally into the drum, said apparatus comprising, a plurality of spaced apart lifter elements connected to the inside of the drum for rotation with the drum to engage logs in the drum and lift and rotate the logs to remove bark from the logs, a reinforcing ring secured to the drum adjacent the inlet of the drum, and means adjacent the inlet of the debarking drum and rotatable with the drum for engaging portions of logs adjacent the inlet and directing the engaged portions of the logs away from the sidewall of the drum to minimize rolling of such logs around the inlet of the drum.

14. Apparatus according to claim 13 wherein said means for engaging portions of logs adjacent said inlet comprises, end portions of said lifter elements which slope toward the inside surface of the drum.

15. Apparatus according to claim 13 wherein said ring comprises a ring having a scalloped inner surface, and said means for engaging portions of logs adjacent said inlet comprises, a plurality of spaced apart projections extending inwardly from the scalloped inner surface of said ring.

16. Apparatus according to claim 15 wherein said projections comprise projections covering ends of said lifter elements adjacent said inlet, and means securing said ends of said lifter elements to said projections.

17. Apparatus according to claim 15 wherein said projections comprise projections of a shape different from the shape of the ends of said lifters.

18. Apparatus according to claim 13 wherein, said ring comprises a ring of an inside dimension in the regions between said lifters which is greater than the diameter of a circle passing through log engaging tip portions of the lifters.

* * * * *